US010184353B2

(12) United States Patent
Tholen et al.

(10) Patent No.: US 10,184,353 B2
(45) Date of Patent: Jan. 22, 2019

(54) BLADE OUTER AIR SEAL COOLING SCHEME

(71) Applicant: United Technologies Corporation, Hartford, CT (US)

(72) Inventors: Susan M. Tholen, Kennebunk, ME (US); Dominic J. Mongillo, West Hartford, CT (US); Paul M. Lutjen, Kennebunkport, ME (US); James N. Knapp, Sanford, ME (US); Virginia L. Ross, Madison, WI (US); Jonathan J. Earl, Wells, ME (US); Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 375 days.

(21) Appl. No.: 15/049,775

(22) Filed: Feb. 22, 2016

(65) Prior Publication Data

US 2016/0208645 A1 Jul. 21, 2016

Related U.S. Application Data

(63) Continuation of application No. 13/529,041, filed on Jun. 21, 2012, now abandoned.

(51) Int. Cl.

| | |
|---|---|
| ***B22C 9/10*** | (2006.01) |
| ***F01D 11/08*** | (2006.01) |
| ***F01D 25/12*** | (2006.01) |

(52) U.S. Cl.

CPC ..... *F01D 25/12* (2013.01); *B22C 9/103* (2013.01); *F01D 11/08* (2013.01)

(58) Field of Classification Search

CPC ..... F01D 11/005; F01D 25/246; F01D 25/12; F01D 11/08; F05D 2240/11;

(Continued)

(56) References Cited

U.S. PATENT DOCUMENTS 5,584,651 A * 12/1996 Pietraszkiewicz ..... F01D 11/08 415/115
6,340,285 B1 * 1/2002 Gonyou ..... F01D 11/005 415/116

(Continued)

FOREIGN PATENT DOCUMENTS

| | | |
|---|---|---|
| EP | 1914030 A1 | 4/2008 |
| EP | 1939400 A2 | 7/2008 |
| EP | 2000232 A1 | 12/2008 |

OTHER PUBLICATIONS

International Search Report and Written Opinion from PCT Application Serial No. PCT/US2013/044898, dated Mar. 20, 2014, 9 pages.

(Continued)

*Primary Examiner* — Richard A Edgar
(74) *Attorney, Agent, or Firm* — Kinney & Lange, P.A.

(57) ABSTRACT

A cooling scheme for a blade outer air seal includes a perimeter cooling arrangement configured to convectively cool a perimeter of the blade outer air seal, and a core cooling arrangement configured to cool a central portion of the blade outer air seal through impingement cooling and to provide film cooling to an inner diameter face of the blade outer air seal.

16 Claims, 6 Drawing Sheets

(58) Field of Classification Search
CPC ..... F05D 2240/40; F05D 2300/6033; Y02T 50/672; B22C 9/103
See application file for complete search history.

(56) References Cited

U.S. PATENT DOCUMENTS

| | | | | |
|---|---|---|---|---|
| 6,637,500 | B2 | 10/2003 | Shah et al. | |
| 6,929,054 | B2 | 8/2005 | Beals et al. | |
| 7,147,432 | B2 | 12/2006 | Lowe et al. | |
| 7,270,170 | B2 | 9/2007 | Beals et al. | |
| 7,296,967 | B2 | 11/2007 | Shapiro | |
| 7,600,967 | B2 | 10/2009 | Pezzetti, Jr. et al. | |
| 7,621,719 | B2 * | 11/2009 | Lutjen ..... | F01D 9/06 415/173.1 |
| 7,686,068 | B2 | 3/2010 | Tholen et al. | |
| 7,874,792 | B2 | 1/2011 | Tholen et al. | |
| 7,959,407 | B2 | 6/2011 | Tholen | |
| 8,302,668 | B1 | 11/2012 | Bullied et al. | |
| 2007/0044933 | A1 | 3/2007 | Santeler | |
| 2007/0053709 | A1 | 3/2007 | Umetsu | |
| 2008/0211192 | A1 | 9/2008 | Pietraszkiewicz et al. | |
| 2009/0087306 | A1 | 4/2009 | Tholen et al. | |
| 2009/0446956 | | 5/2009 | Cunha et al. | |
| 2010/0196160 | A1 | 8/2010 | Hudson | |
| 2011/0236188 | A1 | 9/2011 | Knapp et al. | |
| 2012/0110813 | A1 | 5/2012 | Bullied et al. | |

OTHER PUBLICATIONS

Extended European Search Report, for European Application No. 13833861.1, dated May 12, 2016, 7 pages.

* cited by examiner

BLADE OUTER AIR SEAL COOLING SCHEME

CROSS-REFERENCE TO RELATED APPLICATIONS

This application claims priority as a continuation application under 35 U.S.C. § 120 of earlier filed U.S. application Ser. No. 13/529,041 entitled "BLADE OUTER AIR SEAL HYBRID CASTING CORE" and filed Jun. 21, 2012, which is hereby incorporated by reference in its entirety.

STATEMENT OF GOVERNMENT INTEREST

This invention was made with government support under F33615-03-D-2354-0009 awarded by The United States Air Force. The government has certain rights in the invention.

BACKGROUND

The invention relates to gas turbine engines. More particularly, the invention relates to casting of cooled shrouds or blade outer air seals (BOAS).

BOAS segments may be internally cooled by bleed air. For example, there may be an array of cooling passageways within the BOAS. Cooling air may be fed into the passageways from the outboard (OD) side of the BOAS (e.g., via one or more inlet ports). The cooling air may exit through the outlet ports.

The BOAS segments may be cast via an investment casting process. In an exemplary casting process, a casting core is used to form the passageway legs and other features. The core has legs corresponding to the passageway legs that extend between portions of the core. The core may be placed in a die. Wax may be molded in the die over the core legs to form a pattern. The pattern may be shelled (e.g., a stuccoing process to form a ceramic shell). The wax may be removed from the shell. Metal may be cast in the shell over the core. The shell and core may be destructively removed. After core removal, the core legs leave the passageway legs in the casting. The as-cast passageway legs are open at both circumferential ends of the raw BOAS casting. At least some of the end openings are closed via plug welding, braze pins, welded-on coverplate or other means. Air inlets to the passageway legs may be drilled from the OD side of the casting.

SUMMARY

In one embodiment, a blade outer air seal a main body portion, a perimeter cooling arrangement, and a core cooling arrangement. The main body portion includes a leading edge, a trailing edge, a first circumferential end extending between the leading edge and the trailing edge, a second circumferential end extending between the leading edge and the trailing edge and disposed opposite the first circumferential end, an outer diameter face, and an inner diameter face. The perimeter cooling arrangement includes at least one microcircuit passage extending through a perimeter of the main body portion, a plurality of inlet ports extending through the outer diameter face and configured to provide bleed air to the at least one microcircuit passage, and a plurality of outlet ports extending along one of the first circumferential end and the second circumferential end. The at least one microcircuit passage is configured to provide convection cooling to the perimeter of the blade outer air seal. The core cooling arrangement includes a central cavity disposed within the main body portion, at least one inlet aperture extending from the outer diameter face and into the central cavity, and a plurality of outlet aperture extending from the inner diameter face and into the central cavity.

In another embodiment, a cooling arrangement for a blade outer air seal includes a core cooling region configured to cool a central portion of the blade outer air seal and a perimeter cooling region configured to cool a perimeter of the blade outer air seal. The core cooling region includes a central cavity, at least one core inlet configured to provide bleed air to the central cavity, and a plurality of core outlets configured to remove bleed air from the central cavity. The perimeter cooling region includes at least one microcircuit passage disposed at a perimeter of the blade outer air seal, a plurality of perimeter inlets configured to provide bleed air to the plurality of microcircuit passages, and a plurality of perimeter outlets connected to the at least one microcircuit passage. The core cooling region is isolated from the perimeter cooling region.

In yet another embodiment, a method of cooling a blade outer air seal includes passing a first portion of bleed air to a perimeter cooling circuit through a perimeter cooling inlet, passing a second portion of bleed air to a core cooling region through a core cooling inlet, cooling a perimeter of the blade outer air seal with the first portion of bleed air, wherein the first portion of bleed air convectively cools the perimeter of the blade outer air seal, and cooling a central cavity of the blade outer air seal with the second portion of bleed air.

DETAILED DESCRIPTION

Figure 1:
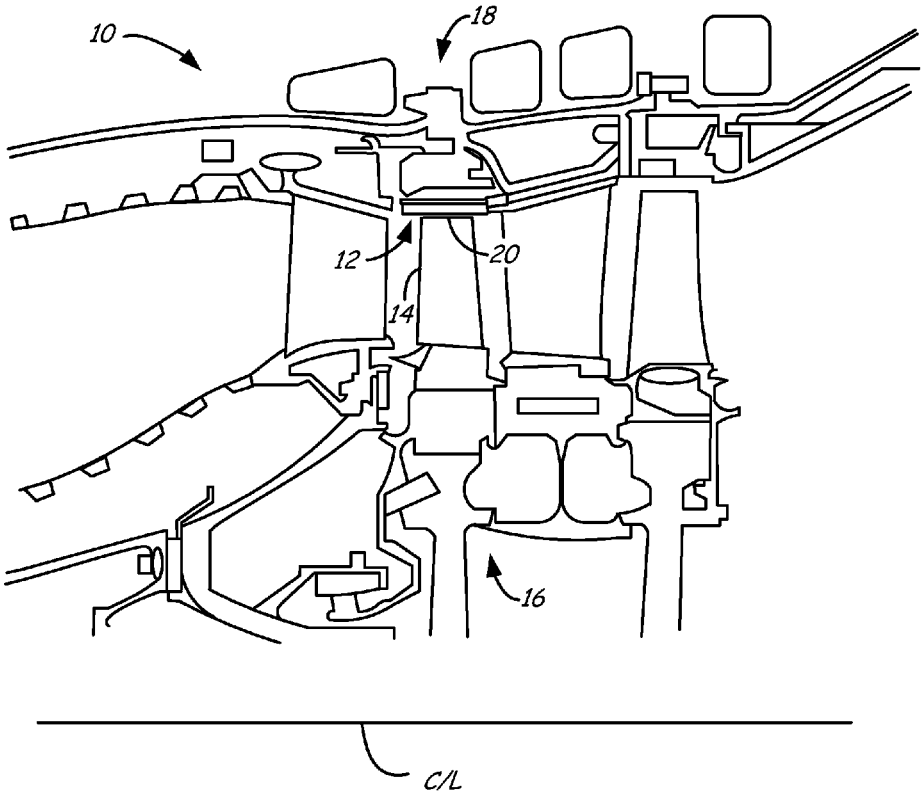
FIG. 1 is a cross-sectional view of a turbine section of a gas turbine engine.

Referring to FIG. 1, a section of a gas turbine engine 10 includes a blade outer air seal 12 (hereinafter "BOAS") disposed between a plurality of circumferentially disposed rotor blades 14 of a rotor stage 16 and an annular outer engine case 18 (hereinafter "engine case"). In one embodiment, the BOAS 12 includes a plurality of circumferentially extending segments and is adapted to limit air leakage between blade tips 20 and the engine case 18 that are evenly spaced about an engine centerline C/L.

Figure 2:
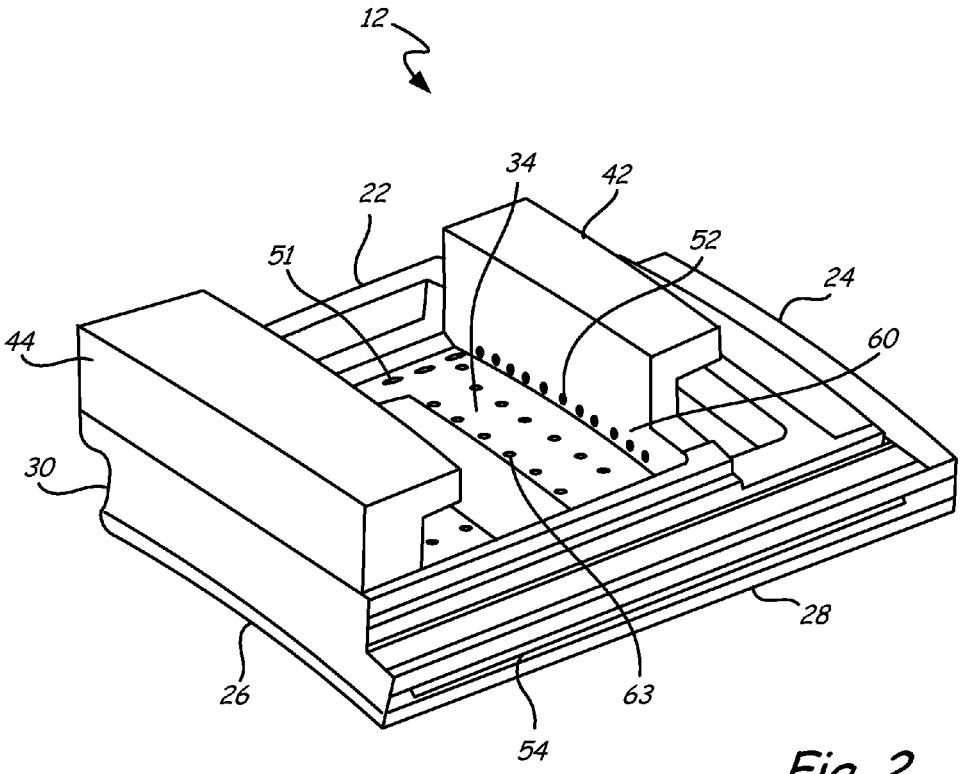
FIG. 2 is a top perspective view of a BOAS.
Figure 3:
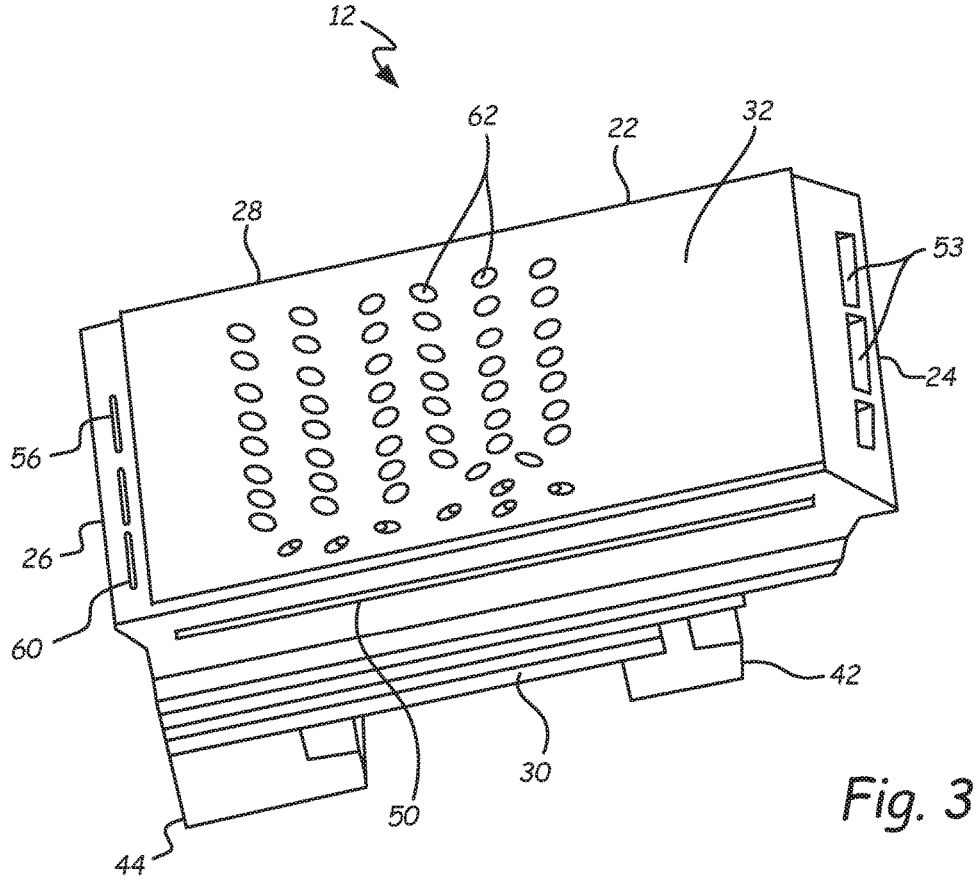
FIG. 3 is a bottom perspective view of the BOAS.
Figure 4:
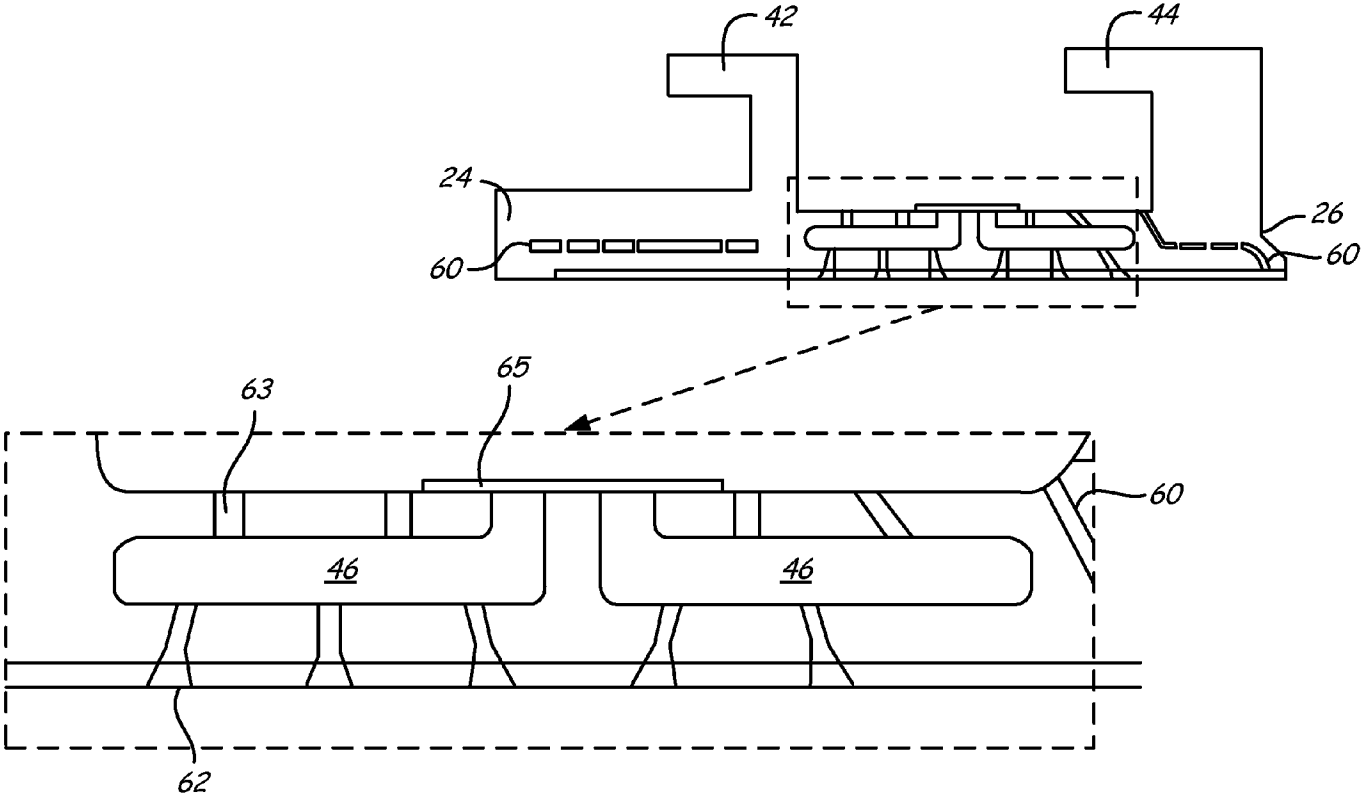
FIG. 4 is a cross-sectional view of the BOAS.

FIG. 2 is a top perspective view of BOAS 12, and FIG. 3 is a bottom perspective view of the BOAS 12. FIG. 4 is a cross-section of BOAS 12. BOAS 12 has a main body portion 22 having a leading/upstream/forward end 24 and a trailing/downstream/aft end 26. The body has first and second circumferential ends or matefaces 28 and 30. The body has an ID face 32 and an OD face 34. To mount BOAS 12 to environmental structure of gas turbine engine 10 (FIG. 1), BOAS 12 has a plurality of mounting hooks including forward mounting hooks 42 having a forwardly-projecting distal portion recessed aft of the forward end 24, and aft hooks 44. Cooling air enters center cavity via aperture 63 on OD face 34 between forward mounting hooks 42 and aft hooks 44 and exits center cavity via aperture 62 on ID face 32.

A circumferential ring array of a plurality of BOAS 12 may encircle an associated blade stage of gas turbine engine 10. The assembled ID faces 32 thus locally bound an outboard extreme of the core flowpath for gases exiting the combustor. BOAS 12 may have features for interlocking the array. Exemplary features include finger and shiplap joints.

BOAS 12 is air-cooled. Bleed air may be directed to a chamber (FIG. 1) immediately outboard of the face 34. The bleed air may be directed through ports 51, 52, 53, 54, 56 that create internal cooling passageway network 60. The exemplary network includes a plurality of passages from the interior chamber of BOAS 12 to a plurality of outlets. Exemplary outlets may include outlets along the circumferential ends 28 and 30. In the exemplary BOAS 12, some outlets are ports 54 are formed along the first circumferential end 28 and some outlets are ports 50 formed along the second circumferential end 30. As is discussed in further detail below, adjacent ports may be interconnected by interconnecting passageways.

In operation, exits from the ID face 32 are fed by passages from internal cooling passageway network 60. In addition, apertures 62 extend from central cavity to ID face 32, and apertures 63 feed central cavity with bleed air from OD face 34. In some embodiments, center cavity may contain an impingement plate 65 to regulate or meter the flow of bleed air from the chamber above. Internal cooling passageway network 60 provides convection cooling of the perimeter of BOAS 12. Apertures 62 allow for film cooling of ID face 32 of BOAS 12.

Figure 5:
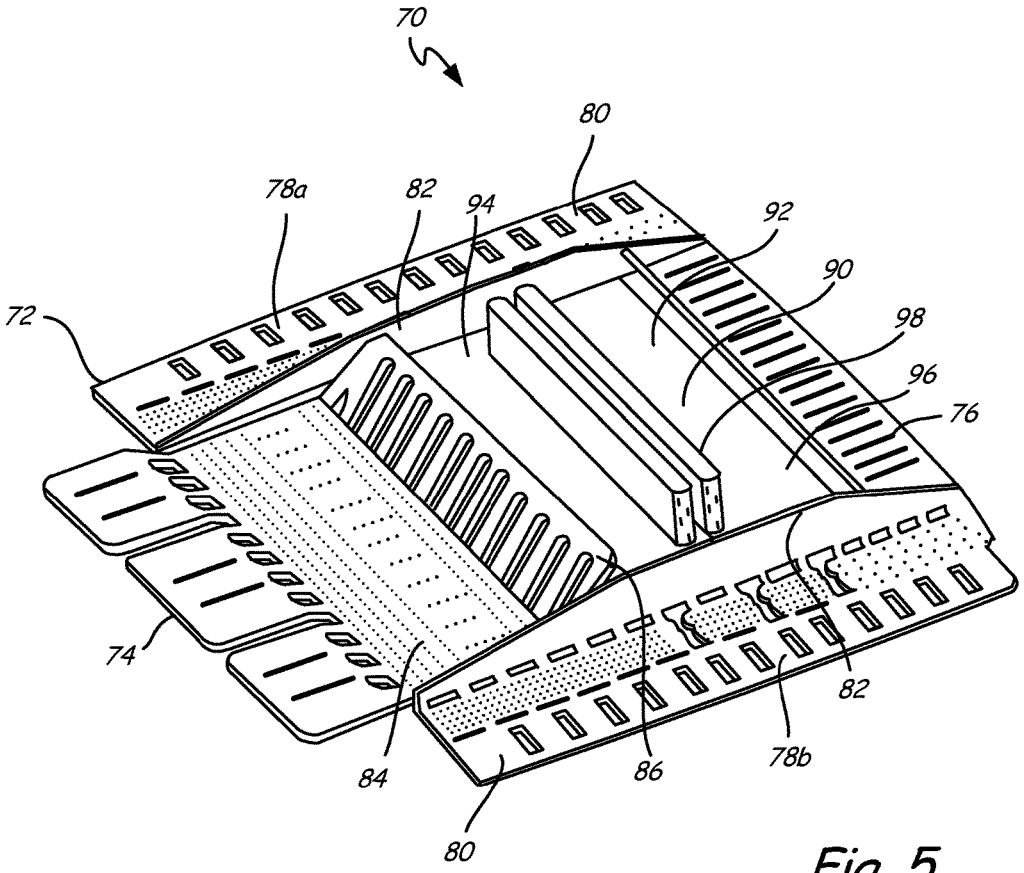
FIG. 5 is a perspective view of a hybrid casting core for the BOAS.

BOAS 12 is a cast engine component. The casting system includes the base shape formed from a metal or metal alloy such as a nickel based superalloy. FIG. 5 is a perspective view of a hybrid casting core 70 for BOAS 12. Hybrid casting core is comprised of refractory metal core (hereinafter "RMC") 72 and ceramic core 90. RMC core 72 may be formed by any suitable metallic material known in the art.

Figure 6:
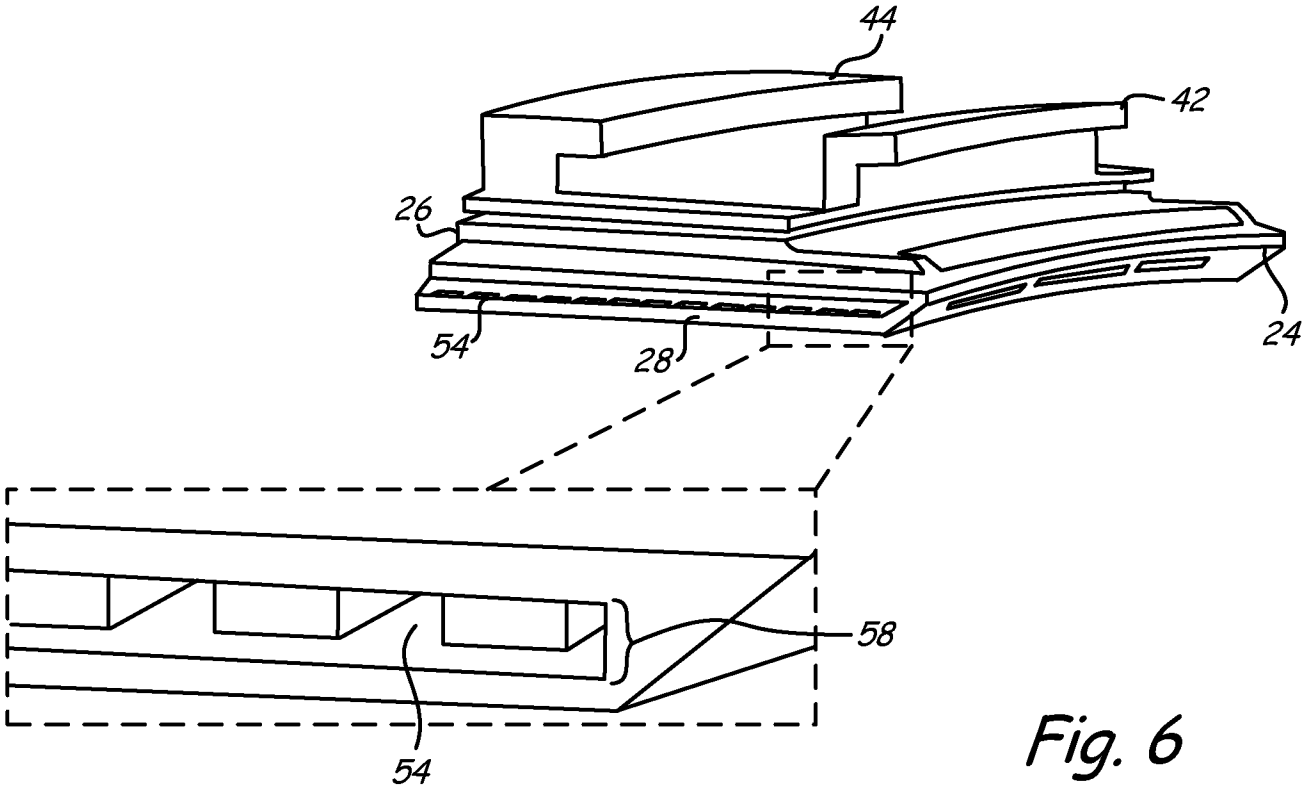
FIG. 6 is a perspective view of the BOAS with an enlarged view of one side.

RMC 72 contains leading edge core 74, trailing edge core 76, and side cores 78*a* and 78*b*. In one embodiment, side cores 78*a* and 78*b* are mirror images of one another, while in other embodiments (such as the one illustrated) the cores contain different geometries to focus the convection cooling of BOAS 12 based on the geometry of BOAS 12. Side cores 78*a* and 78*b* contain axial portions 80 and radial portions 82. Radial portions 82 contain angled legs that allow for the formation of passages that extend through BOAS 12 to connect airflow to the generally axial outlet ports 50 and 54. In some embodiments, axial portion 80 is utilized to create a recessed channel 58 in matefaces 28 and 30 (see FIG. 6). Casting channel 58 rather than machining the same structure desensitizes flow through adjacent passages and apertures to machining burrs. The design also simplifies the casting process through the use of RMC 72, which produces channel 58 without additional concerns of a fully enclosed passage.

Similar to the construction of side cores 78*a* and 78*b*, leading edge core 74 contains both flat axial portions 84 and radial angled portions 86. The angles between the axial portion 84 and radial portions 86 may vary, and typically are designed to be either 45°, 60°, or 90° with respect to one another. Leading edge core 74, trailing edge core 76, and side cores 78*a* and 78*b* may be separate and distinct parts, or in alternate embodiments may be joined into three, two, or a single core through fabrication techniques commonly used in the art, such as welding or brazing.

Ceramic core 90 may be comprised of two separate core pieces 92 and 94, with each part being a mirror copy of the other, or in another embodiment, the same geometry with one piece rotated 180 degrees from the other. Thus, although formed as two individual parts, only a single pattern is required for construction of the core which saves time and controls cost of the finished component incorporating the parts. Core pieces 92 and 94 each contain an axial portion 96 and a radial portion 98. Ceramic core 90 is utilized to create central cavity in BOAS 12. Upon the part being cast, apertures 62 and 63 are formed, such as by laser drilling or electro-discharge machining.

RMC 72 may be bonded to ceramic core 90, such as by adhesives. The exemplary ceramic adhesive may initially be formed of a slurry comprising ceramic powder and organic or inorganic binders. With a binder combination, the organic binder(s) (e.g., acrylics, epoxies, plastics, and the like) could allow for improved room temperature strength of a joint while the inorganic binder(s) (e.g., colloidal silica and the like) may convert to ceramic(s) at a moderate temperature (e.g., 500 C). Adhesives may be used to secure RMCs to pre-formed green cores or may be used to secure RMCs to fired ceramic cores. Adhesive may be used in combination with further mechanical interlocking features.

An exemplary RMC 72 may easily be formed from sheetstock. RMCs with various features may be cast or machined, or assembled from multiple sheet pieces or folded from a single sheet piece. Exemplary RMC materials are refractory alloys of Mo, Nb, Ta, and W. These are commercially available in standard shapes, such as sheets, which can be cut as needed to form cores using processes such as laser cutting, shearing, piercing and photo etching. The cut shapes can be deformed by bending and twisting. The standard shapes can be corrugated or dimpled to produce passages which induce turbulent airflow. Holes can be punched into sheet to produce posts or turning vanes in passageways.

Refractory metals are generally prone to oxidize at elevated temperatures and are also somewhat soluble in molten superalloys. Accordingly, the RMCs may advantageously have a protective coating to prevent oxidation and erosion by molten metal. These may include coatings of one or more thin continuous adherent ceramic layers. Suitable coating materials include silica, alumina, zirconia, chromia, mullite and hafnia. Preferably, the coefficient of thermal expansion (CTE) of the refractory metal and the coating are similar. Coatings may be applied by CVD, PVD, electrophoresis, and sol gel techniques. Individual layers may typically be 0.1 to 1 mil thick. Metallic layers of Pt, other noble metals, Cr, and Al may be applied to the RMCs for oxidation protection, in combination with a ceramic coating for protection from molten metal erosion.

Refractory metal alloys and intermetallics such as Mo alloys and MoSi2, respectively, which form protective SiO2 layers may also be used for RMCs. Such materials are expected to allow good adherence of a non-reactive oxide such as alumina. Silica, though an oxide, is very reactive in the presence of nickel based alloys and is advantageously coated with a thin layer of other non-reactive oxide. However, by the same token, silica readily diffusion bonds with other oxides such as alumina forming mullite.

After the casting process is complete, the shell and core assembly are removed. The shell is external and can be removed by mechanical means to break the ceramic away from the casting, followed as necessary by chemical means usually involving immersion in a caustic solution to remove to core assembly. Typically, ceramic cores are removed using caustic solutions, often under conditions of elevated temperatures and pressures in an autoclave. The same caustic solution core removal techniques may be employed to remove the present ceramic cores. The RMCs may be removed from superalloy castings by acid treatments. For example, to remove Mo cores from a nickel superalloy, one may use an exemplary 40 parts HNO3, 30 parts H2SO4, with balance H2O at temperatures of 60-100° C. For refractory metal cores of relatively large cross-sectional dimensions thermal oxidation can be used to remove Mo which forms a volatile oxide. In Mo cores of small cross-sections, thermal oxidation may be less effective.

Hybrid casting core 70 allows for an exemplary method for investment casting. Other methods are possible, including a variety of prior art methods and yet-developed methods. Hybrid casting core 70 assembly is overmolded with an easily sacrificed material such as a natural or synthetic wax (e.g., via placing the assembly in a mold and molding the wax around it). There may be multiple such assemblies involved in a given mold.

The overmolded hybrid core assembly (or group of assemblies) forms a casting pattern with an exterior shape largely corresponding to the exterior shape of the part to be cast. The pattern may then be assembled to a shelling fixture (e.g., via wax welding between end plates of the fixture). The pattern may then be shelled (e.g., via one or more stages of slurry dipping, slurry spraying, or the like). After the shell is built up, it may be dried. The drying provides the shell with at least sufficient strength or other physical integrity properties to permit subsequent processing. For example, the shell containing the invested core assembly may be disassembled fully or partially from the shelling fixture and then transferred to a dewaxer (e.g., a steam autoclave). In the dewaxer, a steam dewax process removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred to a furnace (e.g., containing air or other oxidizing atmosphere) in which it is heated to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected. The mold may be transferred to a casting furnace (e.g., placed atop a chill plate in the furnace). The casting furnace may be pumped down to vacuum or charged with a non-oxidizing atmosphere (e.g., inert gas) to prevent oxidation of the casting alloy. The casting furnace is heated to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured into the mold and the mold is allowed to cool to solidify the alloy (e.g., after withdrawal from the furnace hot zone). After solidification, the vacuum may be broken and the chilled mold removed from the casting furnace. The shell may be removed in a deshelling process (e.g., mechanical breaking of the shell).

The core assembly is removed in a decoring process to leave a cast article (e.g., a metallic precursor of the ultimate part). The cast article may be machined, chemically and/or thermally treated and coated to form the ultimate part. Some or all of any machining or chemical or thermal treatment may be performed before the decoring.

The design of BOAS 12 may involve providing increased cooling to the BOAS. In an exemplary design situation, shifting of the inlets provides the resulting flows with shorter flowpath length than the length (circumferential) of the baseline passageway. In some situations the baseline passages may have been flow-limited due to the pressure loss from the friction along the relatively larger flowpath length. The ratio of pressures just before to just after the outlet determines the flow rate (and thus the cooling capability). For example, a broader design of the engine may increase BOAS 12 heat load and thus increase cooling requirements. Thus, reducing the pressure drop by shortening the flowpath length may provide such increased cooling. RMC core 72 provides an alternative to circumferentially shortening the BOAS (which shortening leads to more segments per engine and thus more cost and leakage) or further complicating the passageway configuration. Alternatively, the design may increase the BOAS circumferential length and decrease part count/cost and air loss.

There may be one or more of several advantages to using the exemplary RMC core 72 with ceramic core 90. The combination of microcircuit and impingement/film technologies allow for a greater use of design configurations to obtain proper cooling of the component. Impingement provided through ceramic core 90 with film cooling from aperture 62 control the thermal gradient of the component and provides adequate thermal mechanical fatigue life for BOAS 12. RMC 72 creates microcircuit passages, which are arranged at the perimeter of BOAS 12 to provide better cooling to those regions most susceptible to oxidation. Hybrid casting core 70 isolates the center region from secondary distress by mitigating the risk of burn through progressing from the edges.

Use of RMC core may avoid or reduce the need for plug welding. Use of RMC core 72 for internal cooling passageway network 60 relative to a ceramic core may permit the casting of finer passageways. Where the finer passageways are not needed, i.e., central cavity, ceramic core 90 may be utilized. For example, core thickness and passageway height may be reduced relative to those of a baseline ceramic core and its cast passageways by utilizing RMC core 72. Exemplary RMC thicknesses are typically 0.5-11.0 mm, and more narrowly, less than 1.25 mm. RMC core 72 may also readily be provided with features (e.g., stamped/embossed or laser etched recesses) for casting internal trip strips or other surface enhancements. Meanwhile, ceramic core 90 is cheaper to create, and the size and location of apertures 62 and 63 allow for the easy manufacturing of said apertures without the concerns associated with finer passageways, such as plugging with machining slurry during material removal, the complexity of machining convoluted passages, and obstacles related to the deburring process of small passages.

Discussion of Possible Embodiments

The following are non-exclusive descriptions of possible embodiments of the present invention.

A hybrid sacrificial core for forming an impingement space and an internal cooling passageway network separate from the impingement space of a part may comprise a ceramic core having a first surface portion for forming the impingement space, and a refractory metal core that forms a plurality of passages of the internal cooling passageway network.

The core of the preceding paragraph can optionally include, additionally and/or alternatively any one or more of the following features, configurations, and/or additional components:

the ceramic core is comprised of at least two distinct parts;

the two distinct parts are of the same geometry;

the refractory metal core is comprised of four distinct parts;

refractory metal cores may be mirror images of one another;

the refractory metal core is comprised of a leading edge core, a trailing edge core, and two side cores;

the four distinct parts are joined together;

at least one of the distinct parts contains an axial portion and a radial portion;

the four distinct parts are arranged at ninety degrees with respect to each adjacent part, and a generally rectangular space is contained among the four distinct parts;

the ceramic core is placed in the generally rectangular space;

the ceramic core is attached to the refractory metal core.

A method comprises fabricating a refractory metal core to define a plurality of passages of an internal cooling passageway network, fabricating a ceramic core to define an impingement cavity, molding a sacrificial material over the refractory metal core and ceramic core to form a hybrid casting core, and casting a component containing the hybrid core.

The assembly of the preceding paragraph can optionally include, additionally and/or alternatively any one or more of the following features, configurations, steps, and/or additional components:

shelling the sacrificial material;

removing the shell;

the component being cast is a blade outer air seal;

drilling a plurality of apertures on an inner diameter face to the impingement cavity;

drilling a plurality of apertures on an outer diameter face to the impingement cavity;

the impingement cavity is centrally located within the component, and internal cooling passageway network is peripherally located within the component.

A sacrificial core forms a cooling network in a part that includes a network of closed cooling passages and an open channel on at least one face that contains at least one terminating aperture for at least one cooling passage. The core comprises a refractory metal core with a plurality of extensions connected together to form the cooling passages, and a protrusion connected to at least one of the extensions to form the channel.

The core of the preceding paragraph can optionally include, additionally and/or alternatively any one or more of the following features, configurations, and/or additional components:

the refractory metal core is comprised of four distinct parts, each distinct part containing a plurality of extensions;

the refractory metal core is comprised of a leading edge core, a trailing edge core, and two side cores, wherein at least one of the side cores contains the protrusion connected to at least one of the extensions;

the four distinct parts are joined together;

at least one of the distinct parts contains an axial portion and a radial portion.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A blade outer air seal comprising:

a main body portion including:

a leading edge;

a trailing edge;

a first circumferential end extending between the leading edge and the trailing edge;

a second circumferential end extending between the leading edge and the trailing edge and disposed opposite the first circumferential end;

an outer diameter face; and an inner diameter face;

a perimeter cooling arrangement comprising:

at least one microcircuit passage extending through a perimeter of the main body portion, the at least one microcircuit passage comprising:

a first microcircuit passage disposed within the leading edge;

a second microcircuit passage disposed within the trailing edge;

a third microcircuit passage disposed within the first circumferential edge; and a fourth microcircuit passage disposed within the second circumferential edge;

wherein the third microcircuit passage is a mirror image of the fourth microcircuit passage;

a plurality of inlet ports extending through the outer diameter face and configured to provide bleed air to the at least one microcircuit passage; and a plurality of outlet ports extending along one of the first circumferential end and the second circumferential end;

wherein the at least one microcircuit passage is configured to provide convection cooling to the perimeter of the blade outer air seal; and a core cooling arrangement comprising:

a central cavity disposed within the main body portion;

at least one inlet aperture extending from the outer diameter face and into the central cavity; and a plurality of outlet apertures extending from the inner diameter face and into the central cavity.

2. The blade outer air seal of claim 1, wherein the perimeter cooling arrangement is isolated from the core cooling arrangement.

3. The blade outer air seal of claim 1, wherein the first circumferential end further comprises:

a recessed channel, such that the plurality of outlet ports extending through the first circumferential end terminate inboard of the first circumferential end.

4. The blade outer air seal of claim 3, wherein the second circumferential end further comprises:

a recessed channel, such that the plurality of outlet ports extending through the second circumferential end terminate inboard of the second circumferential end.

5. The blade outer air seal of claim 1, wherein the plurality of outlet apertures are configured to provide bleed air from the central cavity to film cool the inner diameter face.

6. The blade outer air seal of claim 1, wherein the core cooling arrangement further comprises:

an impingement plate mounted on the outer diameter face, wherein the impingement plate is configured to meter a flow of bleed air entering the central cavity.

7. The blade outer air seal of claim 1, wherein the blade outer air seal is a cast engine component, wherein the perimeter cooling arrangement is formed by at least one refractory metal core, and wherein the core cooling arrangement is formed by a ceramic core.

8. The blade outer air seal of claim 1, and further comprising:

at least one forward hook extending from the outer diameter face; and at least one aft hook extending from the outer diameter face;

wherein the core cooling arrangement is disposed within the main body portion between the at least one forward hook and the at least one aft hook.

9. The blade outer air seal of claim 1, wherein the at least one microcircuit passage includes a radial portion and an axial portion.

10. A cooling arrangement for a blade outer air seal, the cooling arrangement comprising:

a core cooling region configured to cool a central portion of the blade outer air seal, the core cooling region comprising:

a central cavity;

at least one core inlet configured to provide bleed air to the central cavity; and a plurality of core outlets configured to remove bleed air from the central cavity;

a perimeter cooling region configured to cool a perimeter of the blade outer air seal, the perimeter cooling region comprising:

at least one microcircuit passage disposed at a perimeter of the blade outer air seal, the at least one microcircuit passage comprising:

a first microcircuit passage disposed within the leading edge;

a second microcircuit passage disposed within the trailing edge;

a third microcircuit passage disposed within the first circumferential edge; and a fourth microcircuit passage disposed within the second circumferential edge;

wherein the third microcircuit passage is a mirror image of the fourth microcircuit passage;

a plurality of perimeter inlets configured to provide bleed air to the at least one microcircuit passage; and a plurality of perimeter outlets connected to the at least one microcircuit passage;

wherein the core cooling region is isolated from the perimeter cooling region.

11. The cooling arrangement of claim 10, wherein the core cooling region is configured to provide impingement cooling to the central portion of the blade outer air seal.

12. The cooling arrangement of claim 11, wherein the core cooling region is configured to provide film cooling to an inner diameter face of the blade outer air seal through the plurality of core outlets.

13. The cooling arrangement of claim 10, wherein the at least one microcircuit passage is configured to provide convective cooling to the perimeter of the blade outer air seal.

14. A method of cooling a blade outer air seal, the method comprising:

passing a first portion of bleed air to a perimeter cooling circuit through a perimeter cooling inlet, the perimeter cooling circuit comprising:

a first microcircuit passage disposed within a leading edge of the blade outer air seal;

a second microcircuit passage disposed within a trailing edge of the blade outer air seal;

a third microcircuit passage disposed within a first circumferential edge of the blade outer air seal; and a fourth microcircuit passage disposed within a second circumferential edge of the blade outer air seal;

wherein the third microcircuit passage is a mirror image of the fourth microcircuit passage;

passing a second portion of bleed air to a core cooling region through a core cooling inlet;

cooling a perimeter of the blade outer air seal with the first portion of bleed air, wherein the first portion of bleed air convectively cools the perimeter of the blade outer air seal; and cooling a central cavity of the blade outer air seal with the second portion of bleed air.

15. The method of claim 14, wherein the step of cooling the central cavity of the blade outer air seal with the second portion of bleed air further comprises:

impinging the second portion of bleed air within the central cavity; and passing the second portion of bleed air out of the central cavity through a core cooling outlet to provide film cooling to an inner diameter face of the blade outer air seal.

16. The method of claim 15, wherein the step of impinging the second portion of bleed air within the central cavity further comprises:

metering the flow of the second portion of bleed air into the central cavity with an impingement plate disposed over the central cavity.

* * * * *